US010216136B2

(12) United States Patent
Suzuki et al.

(10) Patent No.: US 10,216,136 B2
(45) Date of Patent: Feb. 26, 2019

(54) IMAGE FORMING APPARATUS

(71) Applicant: CANON KABUSHIKI KAISHA, Tokyo (JP)

(72) Inventors: Takayuki Suzuki, Kashiwa (JP); Takuya Matsumura, Kashiwa (JP); Nobuhiro Tani, Shiki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/641,533

(22) Filed: Jul. 5, 2017

(65) Prior Publication Data

US 2018/0017935 A1 Jan. 18, 2018

(30) Foreign Application Priority Data

Jul. 12, 2016 (JP) ..... 2016-137495

(51) Int. Cl.
*G03G 21/16* (2006.01)
*G03G 21/18* (2006.01)

(52) U.S. Cl.
CPC ..... *G03G 21/1633* (2013.01); *G03G 21/1842* (2013.01)

(58) Field of Classification Search
CPC ..... G03G 21/1623; G03G 21/1628; G03G 21/1633; G03G 21/1638
See application file for complete search history.

(56) References Cited

U.S. PATENT DOCUMENTS 5,854,965 A * 12/1998 Kasiwabara ..... B65H 29/60 399/381
2003/0031480 A1* 2/2003 Miura ..... G03G 15/234 399/124
2007/0116506 A1* 5/2007 Portig ..... B41J 29/02 400/691
2009/0003869 A1* 1/2009 Takahashi ..... G03G 15/5004 399/75
2009/0169244 A1* 7/2009 Carter ..... G03G 21/1633 399/110
2017/0168449 A1 6/2017 Suzuki
2018/0009625 A1* 1/2018 Kakitani ..... B65H 7/06
2018/0017932 A1* 1/2018 Manabe ..... G03G 15/6529

FOREIGN PATENT DOCUMENTS

JP H10-063163 A 3/1998
JP H11-106093 A 4/1999
JP 2000-147850 A 5/2000

* cited by examiner

*Primary Examiner* — Carla J Therrien
(74) *Attorney, Agent, or Firm* — Venable LLP

(57) ABSTRACT

An image forming apparatus includes an apparatus body, a movable unit relatively movable between a first position and a second position, a lock portion configured to lock the movable unit to the apparatus body and an urging portion. The lock portion includes a locked member provided on one of the movable unit and the apparatus body, and a locking member provided on the other of the movable unit and the apparatus body and configured to move between a lock position and a retracting position. The urging portion is configured to urge the movable unit located at a position between the first position and the second position, toward the first position. The position between the first position and the second position is a position at which the locking member in the lock position and the locked member contact each other.

15 Claims, 6 Drawing Sheets

LOCK STATE

UNLOCK STATE

LOCK STATE

IMAGE FORMING APPARATUS

BACKGROUND OF THE INVENTION

Field of the Invention

The present invention relates to an image forming apparatus that forms an image on a sheet.

Description of the Related Art

Generally, an image forming apparatus, such as a copying machine, a printer, a facsimile, or a multifunction printer in which functions of the foregoing machines are combined with each other, is provided with a cover that can be freely opened and closed with respect to an apparatus body of the image forming apparatus. One image forming apparatus such as Japanese Patent Application Publication No. 2000-147850 includes a lock mechanism that locks the cover so that the cover is not opened. The lock mechanism locks the cover because opening the cover may lead to, for example, a failure of the image forming apparatus or tear of a sheet that is stuck in the apparatus. Locking the cover can prevent the failure of the apparatus and the tear of the sheet.

The lock mechanism of Japanese Patent Application Publication No. 2000-147850 includes a stopper and a pivotable lock actuator provided on the cover and locks the cover by the lock actuator moving into a space between the stopper and the cover. Here, if a user tries to open the cover in a state where the cover is locked by the lock mechanism, the lock actuator and the stopper can be in firm contact with each other, i.e. half-open state of the cover.

As a result, a great frictional force is produced between the lock actuator and the stopper and the motion of the lock actuator may be disturbed by the frictional force. In particular, when the frictional force is greater than a force used to move the lock actuator, it may be difficult to change the lock mechanism from its lock state to unlock state. Thus, the change into the unlock state cannot be reliably performed.

SUMMARY OF THE INVENTION

According to an aspect of the present invention, an image forming apparatus includes an apparatus body, a movable unit relatively movable to the apparatus body between a first position at which the movable unit is positioned when an image is formed and a second position which is away from the first position, a lock portion configured to lock the movable unit to the apparatus body and an urging portion. The lock portion includes a locked member provided on one of the movable unit and the apparatus body, and a locking member provided on the other of the movable unit and the apparatus body and configured to move between a lock position and a retracting position. The lock position is a position at which the locking member engages with the locked member to lock the movable unit, and the retracting position is a position to which the locking member is retracted from the lock position. The urging portion is configured to urge the movable unit located at a position between the first position and the second position, toward the first position. The position between the first position and the second position is a position at which the locking member in the lock position and the locked member contact each other.

Further features of the present invention will become apparent from the following description of exemplary embodiments with reference to the attached drawings.

DESCRIPTION OF THE EMBODIMENTS

Hereinafter, a printer 1 of the present embodiment, which serves as the image forming apparatus, will be described. Here, note that features of components of the below-described embodiments, such as size, material, shape, and relative arrangement, should be changed as necessary depending on a configuration and various conditions of an apparatus to which the present invention is applied, and thus are not intended to limit the scope of the present invention.

Figure 1:
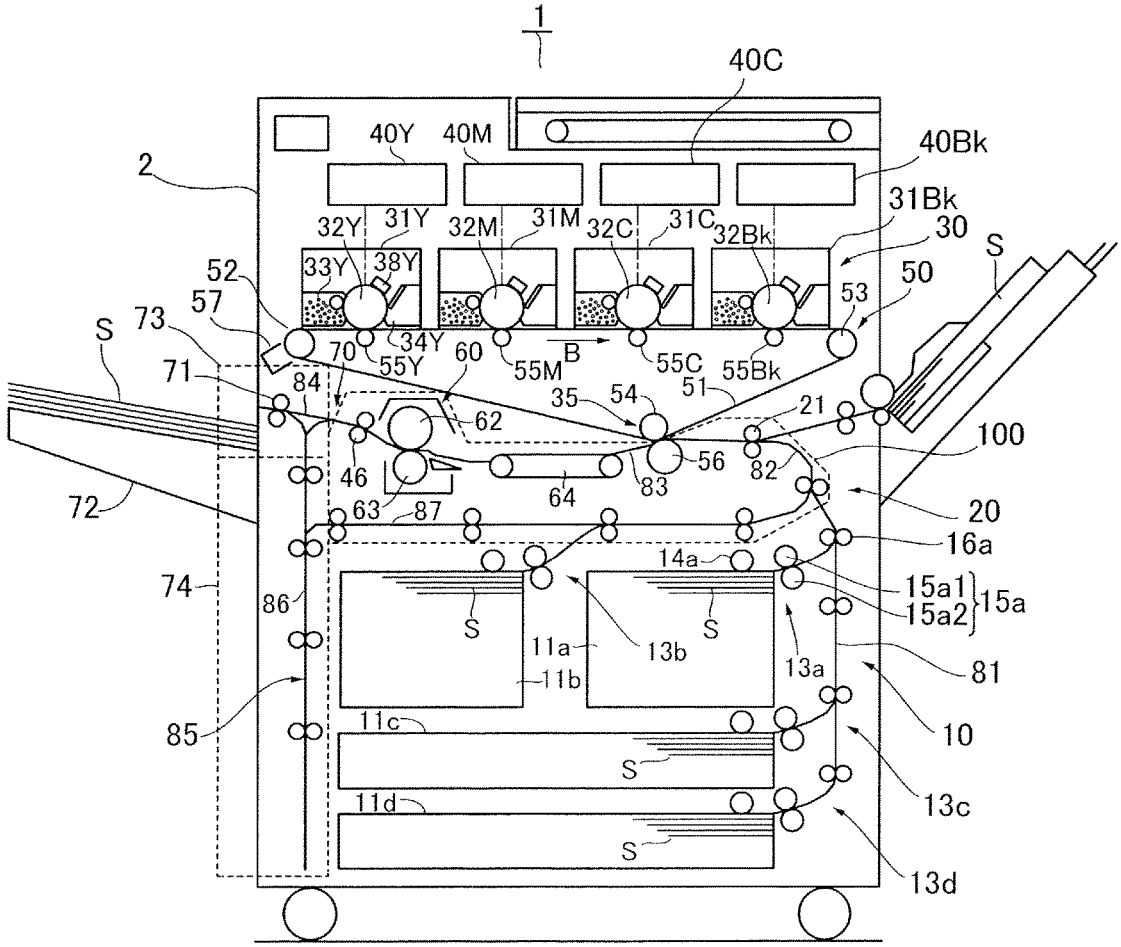
FIG. 1 is a schematic configuration diagram of a printer of an embodiment of the present invention.

As shown in FIG. 1, the printer 1 includes a sheet feeding portion 10 that feeds a sheet, a sheet conveyance portion 20 that conveys the sheet fed by the sheet feeding portion 10, and an image forming portion 30 that forms an image on the sheet conveyed by the sheet conveyance portion 20. The sheet feeding portion 10 includes a plurality of (four in this embodiment) sheet cassettes 11*a*, 11*b*, 11*c*, and 11*d* in a lower portion of an apparatus body 2 of the printer 1. Each of the sheet cassettes 11*a*, 11*b*, 11*c*, and 11*d* storing sheets S is composed of a sheet supporting portion on which the sheets S are supported (stacked). Each of the sheet cassettes 11*a*, 11*b*, 11*c*, and 11*d* is provided with an sheet supporting plate, on which the sheets are supported (stacked). The sheet supporting plate moves up and down so that a sheet height of the uppermost sheet is kept at a predetermined sheet feeding position.

The sheet feeding portion 10 also includes separation feeding portions 13*a*, 13*b*, 13*c*, and 13*d*, each of which separates and feeds the stacked sheets one by one. Since the separation feeding portions 13*a*, 13*b*, 13*c*, and 13*d* have substantially the same configuration, the configuration of only the separation feeding portion 13*a* will be described below, and the description of the configuration of the separation feeding portions 13*b*, 13*c*, and 13*d* will be omitted. The separation feeding portion 13*a* includes a pickup roller 14*a* that contacts and feeds an uppermost sheet of the stacked sheets on the sheet cassette 11*a*, a separation roller pair 15*a* disposed downstream in a sheet conveyance direction of the pickup roller 14*a*, and a drawing roller pair 16*a*. The separation roller pair 15*a* includes a conveyance roller 15*a*1 and a separation roller 15*a*2. The conveyance roller 15*a*1 rotates in the same direction as the pickup roller 14*a*. The separation roller 15*a*2 is driven to rotate in a direction opposite to the sheet conveyance direction, or is stopped from rotating, when two or more sheets are fed at the same time. The conveyance roller 15*a*1 and the separation roller

15*a*2 constitute a separation nip. Thus, the separation nip separates a lower sheet that is fed along with an uppermost sheet, from the uppermost sheet. The drawing roller pair 16*a* is disposed downstream in the sheet conveyance direction of the separation roller pair 15*a*, where the sheet conveyed from the separation roller pair 15*a* is drawn out and conveyed toward a registration roller pair 21 described later.

The sheet conveyance portion 20 includes a plurality of roller pairs disposed downstream in the sheet conveyance direction of the drawing roller pair 16*a*, and conveys the sheet toward a secondary transfer portion 35. The above-described registration roller pair 21 is one roller pair among the plurality of roller pairs, located upstream of the secondary transfer portion 35 and nearest to the secondary transfer portion 35 that transfers an image onto the sheet. The registration roller pair 21 conveys the sheet to the secondary transfer portion 35 in synchronization with an image formation of the image forming portion 30, and performs skew correction of the sheet.

The image forming portion 30 includes process cartridges 31Y, 31M, 31C, and 31Bk for yellow, magenta, cyan, and black, exposing units 40Y, 40M, 40C, and 40Bk provided for the respective process cartridges, and an intermediate transfer unit 50. The process cartridges 31Y, 31M, 31C, and 31Bk are arranged along an intermediate transfer belt 51 in the order of yellow, magenta, cyan, and black. Since the process cartridges have substantially the same configuration except the colors of toner contained, the configuration of only the process cartridge 31Y for yellow will be described below.

The process cartridge 31Y includes a photosensitive drum 32Y, a charging unit 38Y, a developing unit 33Y, and a drum cleaning unit 34Y. The charging unit 38Y, the developing unit 33Y, and the drum cleaning unit 34Y are arranged around the photosensitive drum 32Y. The charging unit 38Y uniformly charges the surface of the photosensitive drum 32Y so that all the surface has the uniform electrical potential. The exposing unit 40Y emits a laser beam, which is produced based on an image signal, to the uniformly charged surface to form an electrostatic latent image on the surface. The electrostatic latent image, formed on the surface of the photosensitive drum 32Y, is developed by the developing unit 33Y to create a toner image.

The intermediate transfer unit 50 includes the intermediate transfer belt 51, a driving roller 52, a tension roller 53, a secondary transfer inner roller 54, and primary transfer rollers 55Y, 55M, 55C, and 55Bk. The intermediate transfer belt 51 is wound around and stretched between these rollers. The primary transfer rollers are arranged to face the above-mentioned yellow, magenta, cyan and black photosensitive drums 32Y, 32M, 32C, and 32Bk with the intermediate transfer belt 51 interposed, and form primary transfer portions together with the photosensitive drums used for the respective colors. Thus, each toner image of each color formed on each photosensitive drum is transferred, in the primary transfer portion, onto the intermediate transfer belt 51 such that one toner image is superimposed on another toner image, so that a full-color toner image is formed on the intermediate transfer belt 51. In the present embodiment, the intermediate transfer belt 51 is driven by the driving roller 52 in a direction indicated by an arrow B in FIG. 1, and the toner images for the respective colors are transferred onto the intermediate transfer belt 51 in the order of yellow, magenta, cyan, and black.

The secondary transfer inner roller 54 is arranged downstream of the primary transfer portion in a rotational direction of the intermediate transfer belt 51, i.e. direction indicated by the arrow B, and constitutes the secondary transfer portion 35 along with a secondary transfer outer roller 56 arranged to face the secondary transfer inner roller 54 with the intermediate transfer belt 51 interposed. When the sheet is conveyed to the secondary transfer portion 35 in synchronization with the conveyance of the full-color toner image formed on the intermediate transfer belt 51, a transfer bias is applied to the secondary transfer outer roller 56 to transfer the full-color toner image onto the sheet. Residual toner on the intermediate transfer belt is removed by a belt cleaning unit 57.

On the downstream side of the secondary transfer portion 35, a pre-fixation conveyance unit 64 and a fixing unit 60 are provided. The pre-fixation conveyance unit 64 conveys the sheet onto which an unfixed-toner image is transferred. The fixing unit 60 is configured to fix the unfixed-toner image onto the sheet. The fixing unit 60 includes a heating roller 62 that contains a halogen heater, and an opposing roller 63 that faces the heating roller 62. The heating roller 62 and the opposing roller 63 constitute a heating nip, which heats and pressurizes the unfixed-toner image and fixes the unfixed-toner image onto the sheet.

The sheet, on which the toner image is fixed by the fixing unit 60 serving as a fixing portion, is conveyed by a sheet discharge portion 70 and discharged to a sheet discharge tray 72 by a sheet discharge roller pair 71. When duplex printing is performed, the sheet is conveyed to a sheet-inversion conveyance unit 74 by a path-branch conveyance unit 73, which is provided between the fixing unit 60 and the sheet discharge roller pair 71. The sheet is then conveyed to a duplex-printing conveyance path 87 by the sheet-inversion conveyance unit 74, and conveyed to the secondary transfer portion 35 again.

Sheet Conveyance Route

Next, a sheet conveyance route of the printer 1 will be described. As shown in FIG. 1, the printer 1 has a sheet conveyance route in the apparatus body 2. The sheet conveyance route includes a sheet feeding path 81, a sheet conveyance path 82, an image forming path 83, a sheet discharge path 84, and a sheet-inversion conveyance path 85. The sheet feeding path 81 extends in a vertical direction in a right side portion (one side) of the apparatus body, and along which the sheet fed by the separation feeding portions 13*a*, 13*c*, and 13*d* are conveyed. The sheet conveyance path 82 is provided downstream with respect to the sheet feeding path 81 in the sheet conveyance direction, and is formed so that the sheet, which has been conveyed along the sheet feeding path 81, is conveyed to the secondary transfer portion 35 along the sheet conveyance path 82. The image forming path is provided downstream with respect to the sheet conveyance path 82 in the sheet conveyance direction, and is formed so that an image forming process is performed in order to form and fix a toner image on the sheet, which is present on the image forming path 83.

The sheet discharge path 84 is provided downstream with respect to the image forming path 83 in the sheet conveyance direction, and is formed so that the sheet, on which the toner image is formed on the image forming path 83, is discharged to the sheet discharge tray 72. The sheet-inversion conveyance path 85 includes a sheet inversion path and a duplex-printing conveyance path 87. The sheet inversion path 86 branches off the sheet discharge path 84 and extends in a downward direction in a left side portion (the other side) of the apparatus body. The duplex-printing conveyance path 87 conveys the sheet that is inverted in the sheet inversion path 86, and back to the sheet conveyance path 82.

Figure 2A:
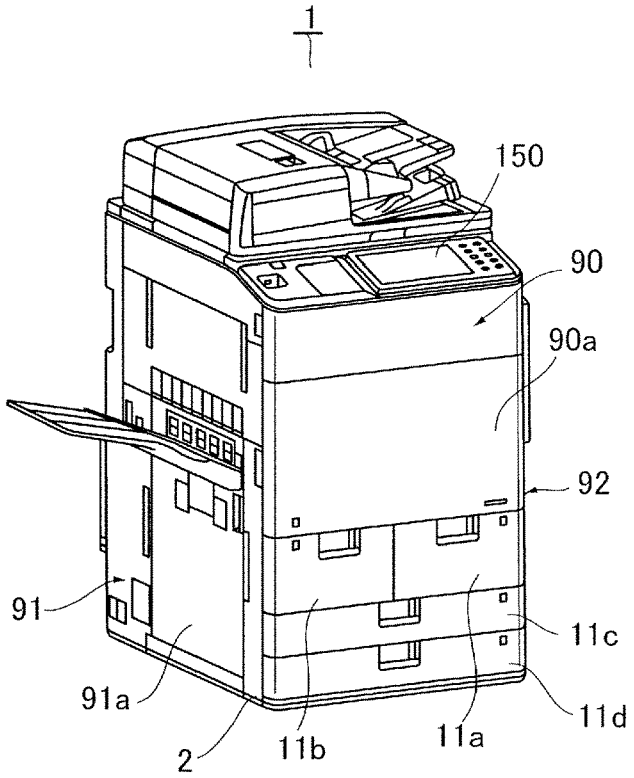
FIG. 2A is a diagram illustrating the printer of FIG. 1 in a state where a front door of the printer is closed.
Figure 2B:
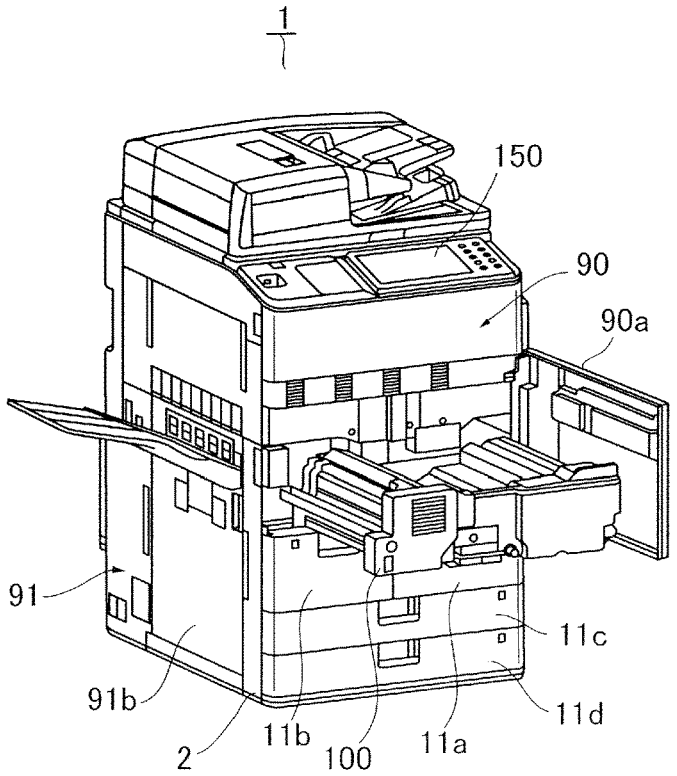
FIG. 2B is a diagram illustrating the printer of FIG. 1 in a state where the front door is opened and a sheet conveyance unit is drawn.

Since the sheet conveyance route is constituted by the plurality of paths 81 to 87, as described above, the sheet can be stuck at any spot of the plurality of paths and cause a sheet jam. As countermeasures to this, as shown in FIGS. 2A and 2B, the printer 1 is configured as follows: the sheet cassettes 11*a* to 11*d* can be drawn out, a front panel 90 is provided with an open-and-close door 90*a*, a left side-panel 91 is provided with an open-and-close door 91*a*, and a right side-panel 92 is provided with an open-and-close door. In addition, the printer 1 is configured such that, when a sheet jam occurs, an occurrence spot of the sheet jam can be accessed through an appropriate route.

The sheet conveyance path 82, the image forming path 83, and the duplex-printing conveyance path 87 constitute a sheet conveyance unit 100, which is unitized and can be drawn out from the apparatus body 2. Specifically, the sheet conveyance unit 100 includes the fixing unit 60 and the pre-fixation conveyance unit 64, and has a configuration in which guide components and conveyance rollers (which constitute the sheet conveyance path 82, the image forming path 83, and the duplex-printing conveyance path 87) are integrally unitized.

Thus, when a sheet jam occurs in the sheet conveyance path 82, the image forming path 83, and/or the duplex-printing conveyance path 87, the printer 1 of the present embodiment can resolve the sheet jam as follows: first, the front door 90*a* of the front panel 90 that covers a front face of the apparatus body is opened; then, the sheet conveyance unit 100 is drawn out from the apparatus body 2 to remove the sheet. When a sheet is stuck in the separation feeding portions 13*a* to 13*d*, each of the sheet cassettes 11*a* to 11*d* is drawn out to remove the sheet, which is stuck in the separation feeding portions. When a sheet jam occurs in the sheet feeding path 81, the open-and-close door (not shown) of the right side-panel 92 is opened to remove the sheet. When a sheet jam occurs in the sheet inversion path 86, the open-and-close door 91*a* of the left side-panel 91 is opened to remove the sheet.

Structure of Lock Unit

Figure 3A:
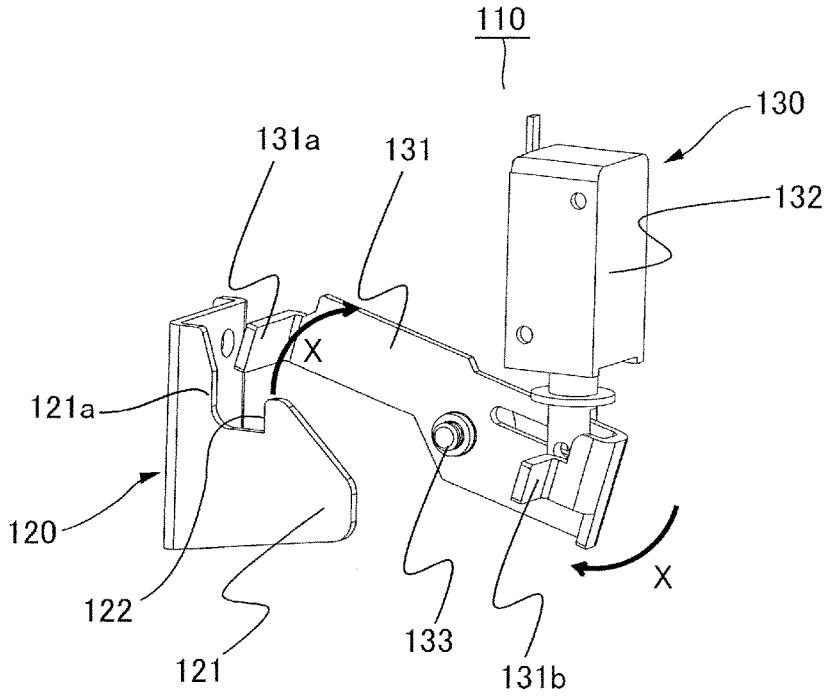
FIG. 3A is a diagram illustrating a lock unit in an unlock state.
Figure 3B:
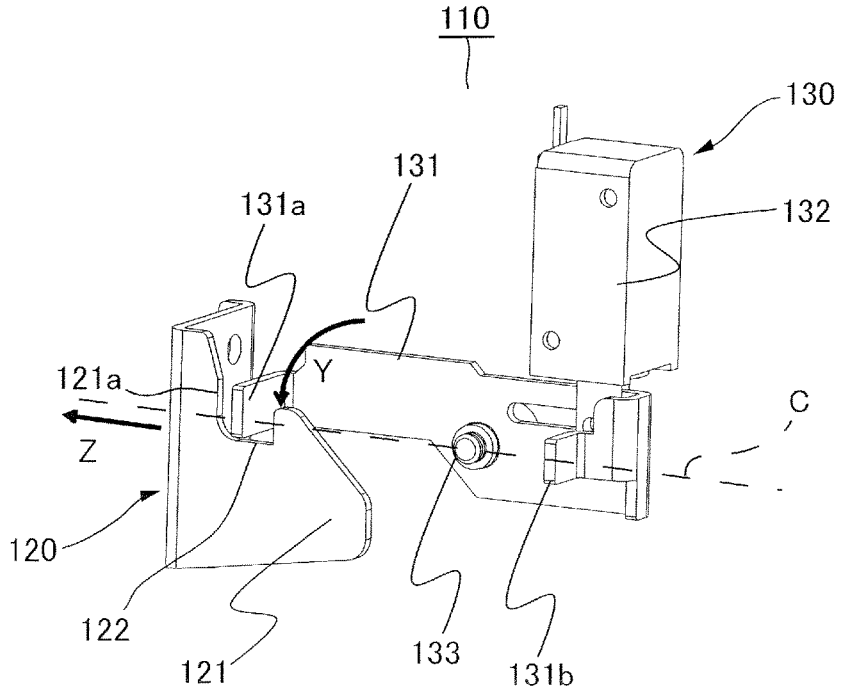
FIG. 3B is a diagram illustrating the lock unit in a lock state.

The printer 1 also includes a lock unit (lock portion) 110 that locks the front door 90*a* so that the front door 90*a* is not opened with respect to the apparatus body 2. As shown in FIGS. 3A and 3B, the lock unit 110 includes a first lock portion 120 provided on the front door 90*a*, and a second lock portion 130 provided on the apparatus body 2. In the present embodiment, the first lock portion 120 is a holder 121 that includes a predetermined gap portion 122 and serves as a locked member. The second lock portion 130 is a drive unit that includes a locking member 131 and a drive source 132. The locking member 131 has an engagement portion 131*a* that moves into or out of the gap portion 122. The drive source 132 allows the engagement portion 131*a* to move into or out of the gap portion 122 of the holder 121.

More specifically, the holder 121 is an electrogalvanized hook member which is fixed on the front door 90*a*, and in which the gap portion 122 is formed by a concave hook portion (concave portion) 121*a*. The opening of the hook portion 121*a* faces upward. The locking member 131 is a plate-like member that is provided such that the locking member 131 can pivot on a pivot supporting axis (pivot shaft) 133 extending in a width direction perpendicular to a moving direction of the front door 90*a* (i.e. front-rear direction of the printer 1). An end portion of the locking member 131 on the front door 90*a* side is bent toward the width direction, and serves as the engagement portion (end portion) 131*a* that engages with the hook portion 121*a*. In addition, the drive source 132 is attached to the locking member 131 at an end portion 131*b* of the locking member 131 on a side opposite to the engagement portion side. The drive source 132 is a solenoid that allows the locking member 131 to pivot on the pivot supporting axis 133. When the solenoid 132 is turned on or off in a state where the front door 90*a* is closed, an iron core of the solenoid 132 moves up or down to pivot the locking member 131, so that a lock state and an unlock state of the front door 90*a* can be changed.

The locking member 131 is structured such that a portion of the locking member 131 on the solenoid 132 side with respect to the pivot shaft 133 weighs more than a portion of the locking member 131 on the engagement portion 131*a* side. In the present embodiment, a weight ratio of the portion on the engagement portion 131*a* side, with respect to the pivot shaft 133, to the portion on the solenoid 132 side is 1:1.4. With this, when the solenoid 132 is turned off, the locking member 131 is subjected to a turning force by its own weight, and pivots toward an X-direction indicated by an arrow in FIG. 3A. Thus, the engagement portion 131*a* moves upward with respect to the holder 121, causing the unlock state of the front door 90*a*.

The lock unit 110 is arranged such that, in the lock state, a line perpendicular to the engagement portion 131*a* of the locking member 131 and to the pivot shaft 133 is substantially parallel to the moving direction of the front door 90*a*, i.e. direction in which the hook moves.

Control in Jam Occurrence

Figure 4:
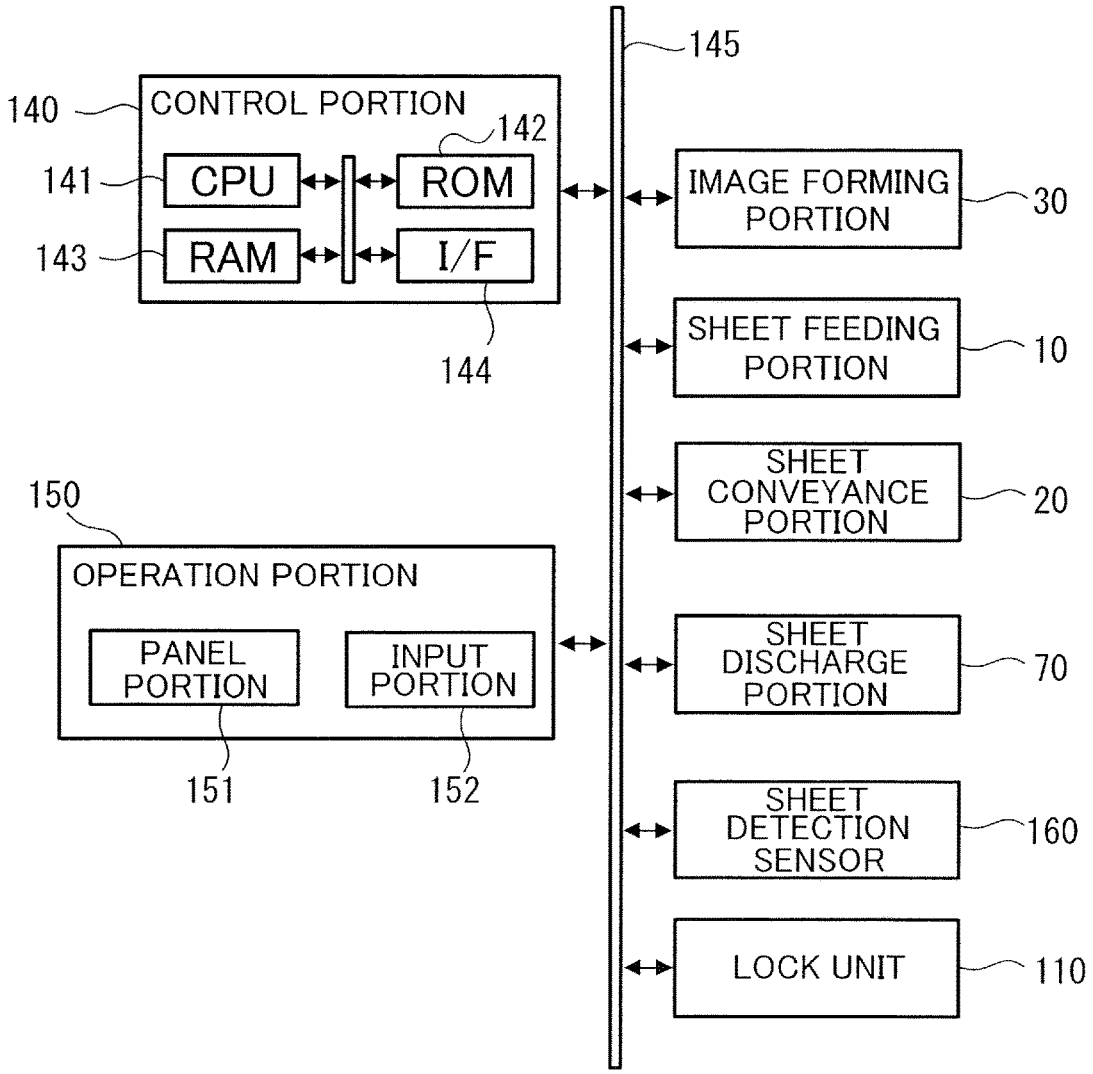
FIG. 4 is a block diagram of a control portion.

Next, a control operation performed when a sheet jam occurs will be described. As shown in FIG. 4, the printer 1 has a control portion 140. The control portion 140 includes a CPU 141 that serves as a calculation portion, and a ROM 142 and a RAM 143 that serve as a memory portion. Also, a plurality of sheet detection sensors 160 used to detect a sheet are provided along the above-described sheet conveyance route. The plurality of sheet detection sensors 160 are connected to the control portion 140 via a bus line 145.

Figure 5:
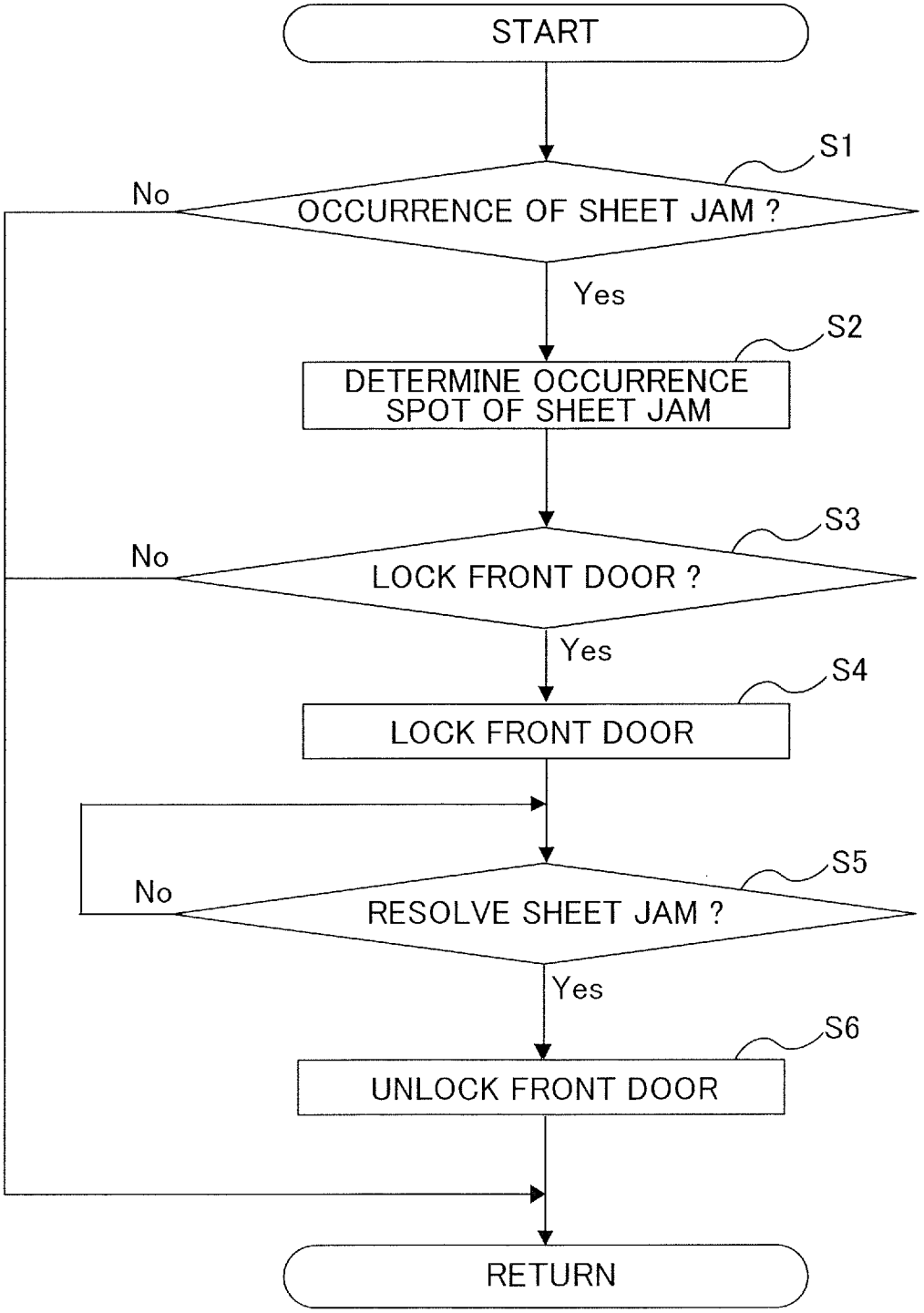
FIG. 5 is a flowchart illustrating a control operation performed in a jam handling.

As shown in FIG. 5, when the control portion 140 detects the occurrence of a sheet jam, depending on a detection result by the sheet detection sensors 160 (S1: Yes), the control portion 140 first determines an occurrence spot of the sheet jam (S2). That is, the control portion 140 detects the position of a sheet that is stuck in the apparatus body, by a certain sensor of the plurality of sheet detection sensors 160 being detecting the sheet, and determines the occurrence spot of the sheet jam.

Then, the control portion 140 determines whether to lock the front door 90*a*, depending on the position of the sheet that is stuck in the apparatus body (S3). That is, when the sheet is stuck across a space between the sheet conveyance unit 100 and the apparatus body 2, the control portion 140 determines to lock the front door 90*a*. In addition, when the occurrence spot of the sheet jam needs to be accessed from another portion (such as the side panel or the sheet cassette) other than the front door 90*a*, the control portion 140 also determines to lock the front door 90*a*. For example, the control portion 140 determines to lock the front door 90*a*, when the leading edge of the sheet reaches the sheet discharge tray 72 and the trailing edge of the sheet remains upstream with respect to the inner discharge roller 46, that is, when the sheet is stuck across a space between the sheet conveyance unit 100, which serves as a drawing unit, and the path-branch conveyance unit 73.

Also, when the control portion 140 determines that the occurrence spot of the sheet jam is a spot for which the control portion 140 needs not to open the front door 90*a* for handling the sheet jam, the control portion 140 turns the solenoid 132 ON to lock the front door 90*a* (S4). Then, the control portion 140 displays a message on a panel portion 151 of an operation portion 150, instructing a user to open the open-and-close door 91*a* of the left side panel 91 or the open-and-close door of the right side panel 92 or to draw the sheet cassettes 11*a* to 11*d* and to resolve the sheet jam.

On the other hand, when the control portion 140 determines that the occurrence spot of the sheet jam is a spot for which the control portion 140 needs to open the front door 90*a* for handling the sheet jam (S3: No), the control portion 140 keeps the solenoid 132 OFF. Then, the control portion 140 displays a message, instructing a user to open the front door 90*a* and to resolve the sheet jam, on the panel portion 151 of the operation portion 150.

After that, when a user follows the instruction to perform the jam-handling operation, and when the control portion 140 detects that the sheet jam is resolved (S5 Yes), the control portion 140 controls the lock unit 110 to unlock the front door 90*a* (S6). Thus, when a sheet is stuck across a space between the sheet conveyance unit 100 and the apparatus body 2 and causes a sheet jam, the front door 90*a* is locked to prevent wrong operation performed by a user, and to prevent the sheet conveyance unit 100 from being drawn out, preventing a sheet from being torn.

Lock Mechanism of Front Door

Figure 6A:
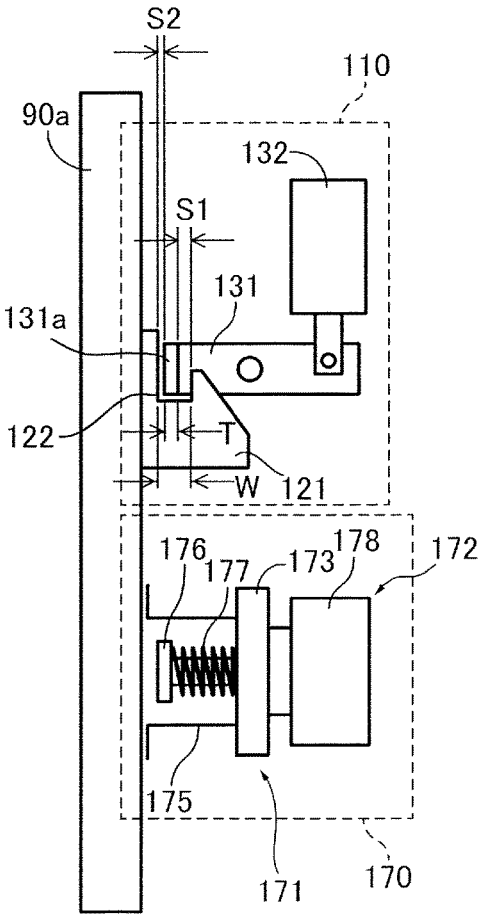
FIG. 6A is a schematic diagram illustrating a lock mechanism in a close state.
Figure 6B:
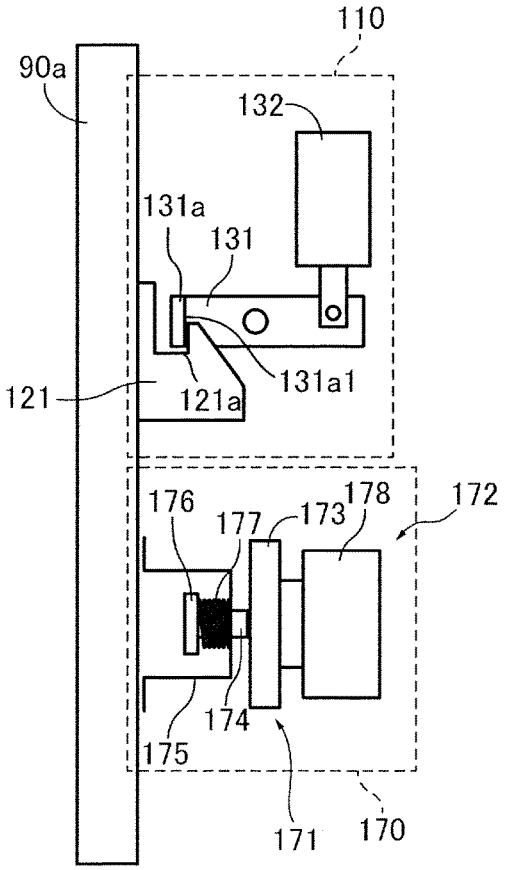
FIG. 6B is a schematic diagram illustrating the lock mechanism in a half-open state.

Next, with reference to FIGS. 6A and 6B, a lock mechanism 170 for the front door 90*a* will be described. The lock mechanism 170 for the front door 90*a* includes a catch unit that holds the front door 90*a* on the apparatus body 2. The catch unit includes a first catch portion 171 provided on the front door 90*a*, and a second catch portion 172 provided on the apparatus body 2. Specifically, in the present embodiment, the second catch portion 172 is a magnet catch 178 provided on the apparatus body 2; the first catch portion 171 includes a sticking metal plate 173, which is a held member held by the magnet catch 178. That is, the first catch portion 171 is provided on the front door 90*a* that serves as a movable unit, and the second catch portion 172 is provided on the apparatus body 2. The first catch portion 171 is held by the second catch portion 172, and thereby the front door 90*a* is held by the apparatus body 2.

As shown in FIGS. 2A and 2B, the front door 90*a* can pivot with the aid of a hinge portion (not shown). With this, when the sticking metal plate 173 sticks to the magnet catch 178, the front door 90*a* is positioned at a first position, at which the front door 90*a* is positioned when images are formed. At the first position, the front door 90*a* is in a close state. Here, the engagement portion 131*a* of the locking member 131 has a thickness T in the moving direction of the front door 90*a*, smaller than a width W of the gap portion 122 of the hook portion 121*a* of the holder 121. Thus, as shown in FIG. 6A, when the front door 90*a* is positioned at the first position and the lock unit 110 is in the lock state, predetermined gaps S1 and S2 are ensured between the holder 121 and the locking member 131 in the moving direction of the front door 90*a*. More specifically, the lock unit 110 is configured such that, while the locking member 131 pivots, the gap S1 is ensured between one side of the engagement portion 131*a* and the holder 121 and the gap S2 is ensured between the other side of the engagement portion 131*a* and the holder 121, in the moving direction of the front door 90*a* so that the engagement portion 131*a* does not rub against the holder and not cause a malfunction.

By the way, when a user mistakenly tries to open the front door 90*a* in a state where the front door 90*a* is locked, a side portion 131*a*1 of the engagement portion 131*a* on a side opposite to the front door 90*a* side contacts the hook portion 121*a* of the holder 121, and locks the front door 90*a* so that the front door 90*a* is not opened. At this time, the front door 90*a* is moved by a distance of the gap S1, and positioned at a third position, at which the side portion 131*a*1 of the engagement portion 131*a* and the holder 121 contact each other. Thus, the front door 90*a* is set in a half-open state. The third position is located between the first position and a second position at which the front door 90*a* is opened. That is, the third position is an intermediate position which is between the first position and the second position, and at which the locking member in a lock position and the locked member contact each other. In the half-open state, however, the sticking metal plate 173 provided on the front door 90*a* can be separated from the magnet catch 178. If the sticking metal plate 173 is separated from the magnet catch 178, the front door 90*a* is displaced from a desired position, and the holder 121 and the locking member 131 can keep contact with each other. In this state, even though the solenoid 132 is energized to release the lock state, the lock state may not be released because the locking member 131 is prevented from pivoting.

As countermeasures to this, the lock mechanism 170 includes a closing mechanism that closes the front door 90*a* in the half-open state, into the close state. Specifically, the first catch portion 171 includes a base 175 and a stopper 176. The base 175 supports the sticking metal plate 173 via a guide shaft 174 such that the sticking metal plate 173 can move in a relative manner. The stopper 176 is provided to an end portion of the guide shaft 174 on a side opposite to the sticking metal plate 173 side. With this configuration, the sticking metal plate 173 is supported such that the sticking metal plate 173 can move along the guide shaft 174 in the moving direction of the front door 90*a*, and is prevented by the stopper 176 from falling off.

In addition, a spring 177 is provided between the sticking metal plate 173 and the base 175. Thus, when the magnet catch 178 and the sticking metal plate 173 are in contact with each other by the magnetic force, the front door 90*a* is urged, by the urging force of the spring 177, toward the direction in which the front door 90*a* is substantially closed. That is, the spring 177 is arranged such that, in the state where the sticking metal plate 173 is held by the magnet catch 178, as the front door 90*a* moves toward the second position, the spring 177 increases its urging force. In addition, the front door 90*a* is positioned at the first position by the base 175 and the sticking metal plate 173 contacting each other.

When a user tried to open the locked front door 90*a*, the front door 90*a* is moved relative to the sticking metal plate 173 while the sticking metal plate 173 sticks to the magnet catch 178. During this, the spring 177, which is arranged between the sticking metal plate 173 and the front door 90*a*, is compressed, increasing its reaction force (i.e. urging force applied to the front door 90*a*).

When the engagement portion 131*a* of the locking member 131 contacts the holder 121 to prevent the front door 90*a* from being opened any more, and when a user moves his/her hand off the front door 90*a*, the urging force of the spring 177 forces the front door 90*a* to move toward the first position. Then, the sticking metal plate 173 contacts the base 175, and the front door 90*a* is positioned at the first position again. The urging force of the spring 177 is set so that the spring force can move the front door 90*a*, located at the position at which the front door 90*a* is positioned when the locking member 131 and the holder 121 contact each other, to the first position in a state where no external force is applied to the front door 90*a*.

When a user tries to open the front door 90*a* in a state where the front door 90*a* is unlocked and the sticking metal plate 173 sticks to the magnet catch 178, the sticking metal plate 173 continues to stick to the magnet catch 178 until the spring 177 is fully contracted and the stopper 176 contacts the base 175. At this time, the spring 177 produces a maximum reaction force, but the maximum reaction force is set smaller than the sticking force of the magnet catch 178. When the user further opens the front door 90*a*, the sticking metal plate 173 is separated from the magnet catch 178 and can be released. That is, with the movement of the movable unit from the first position toward the second position, the first catch portion 171 is no longer held by the second catch portion 172. In the present embodiment, the sticking force of the magnet catch 178 is set at 20 N or more, and the maximum reaction force (maximum urging force) of the spring 177 is set at 10N or less. Preferably, the reaction force of the spring 177 is half or less of the sticking force of the magnet catch 178, as in the present embodiment, in consideration of user operability and the fact that the sticking metal plate 173 can reliably stick to the magnet catch 178.

In the present embodiment, the urging force of the spring 177 that serves as an urging portion can automatically return the front door 90*a* in its half-open state (third position) to the desired position (first position), as described above. This can prevent the lock unit 110 from unlocking the front door 90*a* in the state where the front door 90*a* is in the half-open state, and can pivot the locking member 131 in the state where the gaps S1 and S2 are ensured between the holder 121 and the locking member 131 (i.e. state where there is less frictional force). That is, the present embodiment allows the gaps to be ensured between the hook member 121 and the locking member 131 by the urging force of the spring 177 moving the front door 90*a* to the position at which the front door 90*a* is closed. This can prevent deformation of the door member and insufficient pivoting of the locking member caused by a user mistakenly operating the door into the half-open state, and by the hook member and the locking member contacting each other. With this, the locking member 131 can smoothly pivot. Even in the case where the locking member moves with the aid of its own weight, the locking member 131 can smoothly pivot and the lock mechanism can stably operate. Moreover, since the solenoid can be downsized, power saving and cost reduction are achievable.

In the above-described embodiment, the front door 90*a*, which is used to cover a front face of the apparatus body 2 and can open and close, is the movable unit provided such that the movable unit can move relative to the apparatus body 2. However, the movable unit that can move between the first position, at which the movable unit is positioned when images are formed, and the second position that is away from the first position may be a drawing unit that can be drawn out from the apparatus body 2. That is, the movable unit may be a drawing unit, such as the sheet conveyance unit 100, and the sheet conveyance unit 100 may be locked by the lock unit 110. Alternatively, both the door member and the sheet conveyance unit may be a movable unit that can be locked, and may be locked by the lock unit 110.

Also in the above-described embodiment, the first lock portion 120 is constituted by the holder 121, and the second lock portion 130 is constituted by the drive unit. The present invention, however, is not limited to this. The first lock portion 120 may be constituted by the drive unit, and the second lock portion 130 may be constituted by the holder. That is, the present invention is applicable as long as one of the first and the second lock portions is the holder 121 and the other is the drive unit.

Furthermore, in the present embodiment, since the sticking metal plate 173, which serves as a held member, is supported such that the sticking metal plate 173 can move relative to the movable unit, e.g., front door 90*a*, the held member can be held by the second catch portion 172 even when the movable unit moves to the third position in a state where the movable unit is locked. That is, since the sticking metal plate 173 can move in a relative manner, via the guide shaft 174, in the direction in which the front door 90*a* is opened and closed, the sticking metal plate 173 is not separated from the magnet catch 178 even when a user tried to open the front door 90*a* in a state where the front door 90*a* is locked. That is, when the front door 90*a* moves by a distance of the gap S1, the sticking metal plate 173 can move in a relative manner, following the movement of the front door 90*a*. In addition, the spring 177 that serves as an urging portion is arranged between the held member and the movable unit such that the spring 177 increases its urging force as the movable unit moves toward the second position. Thus, the movement of the movable unit to the third position can also increase the urging force of the spring 177. However, the sticking metal plate that serves as a held member may not necessarily be provided on the movable unit side, but may be provided on the apparatus body side. That is, the first catch portion may be constituted by a component, such as a magnet catch or a C-type catch; the second catch portion may be provided with a held member that engages with the first catch portion and is supported such that the held member can move relative to the apparatus body. In this case, an elastic member is arranged between the held member and the apparatus body so that the urging force of the elastic member increases as the movable unit moves toward the second position.

In the present embodiment, the locking member 131 can move to an unlock position with the aid of its own weight. That is, the locking member 131 moves, with the aid of its own weight, from a lock position at which the locking member 131 is located in the gap portion 122 (i.e. position at which the locking member 131 engages with the locked member and locks the movable unit), to the unlock position (retracting position) to which the locking member 131 is retracted from the gap portion 122. More specifically, the weight balance of the locking member 131 is set such that a rotation moment of the locking member 131 in a direction in which the locking member 131 pivots from the lock position to the unlock position is larger than a rotation moment of the locking member 131 in a direction in which the locking member 131 pivots from the unlock position to the lock position. With this structure, the lock unit can be simplified in configuration, compared to another lock unit which uses an urging member to move the locking member 131 to the unlock position, because the lock unit of the present embodiment has no urging member. The lock unit of the present embodiment can also contribute to reduction in portions cost and assembling cost. Moreover, the present embodiment is also applicable to a case where the use of the urging portion is difficult due to, for example, a spatial restriction, and thus can increase versatility.

In addition, the holder 121 that serves as a hook member and the locking member 131 are positioned in the lock state such that a line C passing through the contact point between the hook member in the third position and the locking member and through the pivot supporting axis (see FIG. 3B) is substantially parallel to the moving direction of the movable unit. Thus, a force (i.e. force applied in a direction indicated by an arrow Z in FIG. 3B) applied by a user who tries to open the movable unit (front door 90*a*) can be received by the pivot shaft 133. Also, since the drive portion needs not to oppose the force applied by a user who moves the exterior cover, the drive portion can be downsized.

The above-described embodiment exemplifies the coil spring 177 that is an elastic member and serves as an urging portion. The present invention, however, is not limited to the coil spring, but can use any component, such as a rubber spring or a plate spring, as long as the component can exert its urging force on the movable unit. Alternatively, a spring member arranged between the front door 90*a* and the apparatus body 2 may be used as an urging portion.

The second catch portion 172 is constituted by the magnet catch 178. However, at least one of the held member and the second catch portion may be a magnet. Both the held member and the second catch portion may be a magnet. The second catch portion 172 may be constituted by not the magnet catch, but another component, such as a C-type catch, that causes the held member to stick to the component by elastic force.

Moreover, in the above-described embodiment, the weight balance of the locking member 131 itself is set such that a portion of the locking member 131 on the solenoid side with respect to the pivot shaft 133 weighs more than a portion of the locking member 131 on the engagement portion side. However, the total weight of the portion on the solenoid side and an ion core may be greater than the weight of the portion on the engagement portion side.

The lock unit 110 is configured such that the locking member moves into or out of the concave gap portion of the hook member. The present invention, however, is not limited to this. For example, the locking member may move into or out of a hole-shaped gap portion. Alternatively, a gap portion may be formed between a main body of the front door and the holder for example, and the locking member may move into or out of the gap portion between the front door and the holder. The lock unit 110 may be configured such that a locking member is moved linearly by a solenoid to move into or out of a gap portion of the holder. In this case, the locking member may move into a hole-shaped gap portion when the solenoid is turned on, and move out of the gap portion by its own weight when the solenoid is turned off. In addition, although the present invention is applied to laser printers in the above-described embodiments, it is not limited to this. For example, the present invention is also applicable to image forming apparatuses, such as ink-jet printers, printing machines, copying machines, and facsimiles. Also, the above-described embodiments may be combined as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-137495, filed Jul. 12, 2016, which is hereby incorporated by reference wherein in its entirety.

What is claimed is:

1. An image forming apparatus comprising:

an apparatus body;

a movable unit relatively movable to the apparatus body between a first position at which the movable unit is positioned when an image is formed and a second position which is away from the first position;

a lock portion configured to lock the movable unit to the apparatus body, the lock portion comprising:

a locked member provided on one of the movable unit and the apparatus body; and a locking member provided on the other of the movable unit and the apparatus body and configured to move between a lock position and a retracting position, the lock position being a position at which the locking member engages with the locked member to lock the movable unit, the retracting position being a position to which the locking member is retracted from the lock position;

an urging portion configured to urge the movable unit located at a position between the first position and the second position, toward the first position, the position between the first position and the second position being a position at which the locking member in the lock position and the locked member contact each other;

a catch unit comprising a first catch portion provided on the movable unit and a second catch portion provided on the apparatus body, the catch unit being configured such that the second catch portion holds the first catch portion to hold the movable unit not to release the movable unit from the apparatus body and releases the first catch portion in response to a movement of the movable unit from the first position toward the second position, wherein the first catch portion comprises a held member that is held by the second catch portion and supported such that the held member can move relative to the movable unit, and the urging portion comprises an elastic member arranged between the held member and the movable unit.

2. The image forming apparatus according to claim 1, wherein the second catch portion comprises a held member that engages with the first catch portion and is supported such that the held member can move relative to the apparatus body, and the urging portion comprises an elastic member arranged between the held member and the apparatus body.

3. The image forming apparatus according to claim 1, wherein the urging portion is arranged between the held member and the movable unit such that, in a state where the held member is held by the second catch portion, urging force of the elastic member increases as the movable unit moves toward the second position.

4. The image forming apparatus according to claim 1, wherein at least one of the held member and the second catch portion comprises a magnet.

5. The image forming apparatus according to claim 4, wherein the urging portion has a maximum urging force smaller than a sticking force of the magnet.

6. The image forming apparatus according to claim 1, wherein the urging portion comprises an elastic member arranged between the movable unit and the apparatus body.

7. The image forming apparatus according to claim 1, wherein the locking member moves from the lock position to the retracting position with the aid of a self-weight of the locking member.

8. The image forming apparatus according to claim 7, wherein the locking member is supported such that the locking member can pivot on a pivot supporting axis, and a weight balance of the locking member is set such that a rotation moment of the locking member in a direction in which the locking member pivots from the lock position to the retracting position is larger than a rotation moment of the locking member in a direction in which the locking member pivots from the retracting position to the lock position.

9. The image forming apparatus according to claim 1, wherein the locking member is supported such that the locking member can pivot on a pivot supporting axis and the locked member and the locking member are positioned such that, when the movable unit is positioned in a state where the locked member and the locking member contact each other, a line passing through a contact point between the locked member and the locking member and through the pivot supporting axis is substantially parallel to a moving direction of the movable unit.

10. The image forming apparatus according to claim 1, wherein the lock portion comprises a solenoid used to move the locking member.

11. The image forming apparatus according to claim 1, wherein the movable unit comprises a door that covers a front face of the apparatus body and can open and close.

12. The image forming apparatus according to claim 1, wherein the movable unit comprises a drawing unit that can be drawn out from the apparatus body.

13. The image forming apparatus according to claim 1, wherein the locked member comprises a predetermined gap portion, and the locking member moves into or out of the gap portion, and has an engagement portion whose thickness in a moving direction of the movable unit is smaller than a width of the gap portion.

14. An image forming apparatus comprising:

an apparatus body;

a movable unit relatively movable to the apparatus body between a first position at which the movable unit is positioned when an image is formed and a second position which is away from the first position;

a lock portion configured to lock the movable unit to the apparatus body, the lock portion comprising:

a locked member provided on one of the movable unit and the apparatus body; and a locking member provided on the other of the movable unit and the apparatus body and configured to move between a lock position and a retracting position, the lock position being a position at which the locking member engages with the locked member to lock the movable unit, the retracting position being a position to which the locking member is retracted from the lock position; and an urging portion configured to urge the movable unit located at a position between the first position and the second position, toward the first position, the position between the first position and the second position being a position at which the locking member in the lock position and the locked member contact each other, wherein the urging portion urges the movable unit, located at the position between the first position and the second position, toward the first position, the position being the position at which the locking member located in the lock position and the locked member contact each other, and wherein the locking member located in the lock position and the locked member do not contact each other in a state where the movable unit is located at the first position.

15. An image forming apparatus comprising:

an apparatus body;

a movable unit relatively movable to the apparatus body between a first position at which the movable unit is positioned when an image is formed and a second position which is away from the first position;

a lock portion configured to lock the movable unit to the apparatus body, the lock portion comprising:

a locked member provided on one of the movable unit and the apparatus body; and a locking member provided on the other of the movable unit and the apparatus body and configured to move between a lock position and a retracting position, the lock position being a position at which the locking member engages with the locked member to lock the movable unit, the retracting position being a position to which the locking member is retracted from the lock position; and an urging portion configured to urge the movable unit located at a position between the first position and the second position, toward the first position, the position between the first position and the second position being a position at which the locking member in the lock position and the locked member contact each other, wherein the locked member comprises a predetermined gap portion, wherein the locking member moves into or out of the gap portion, and has an engagement portion whose thickness in a moving direction of the movable unit is smaller than a width of the gap portion, wherein the locked member is a hook member that comprises the gap portion, and wherein the gap portion is concave.

* * * * *